US005101987A

United States Patent [19]

Twedt

[11] Patent Number: 5,101,987

[45] Date of Patent: Apr. 7, 1992

[54] TELESCOPING PAPER SORTER DEVICE

[75] Inventor: Gary A. Twedt, Chapel Hill, N.C.

[73] Assignee: Automated Insight, Inc., Chapel Hill, N.C.

[21] Appl. No.: 784,878

[22] Filed: Oct. 30, 1991

[51] Int. Cl.[5] ..... A47F 5/00

[52] U.S. Cl. ..... 211/55; 211/88; 211/104

[58] Field of Search ..... 211/55, 104, 56, 201, 211/88

[56] References Cited

U.S. PATENT DOCUMENTS 3,161,298 12/1964 Naslund ..... 211/104
3,717,188 2/1973 Green ..... 211/55 X
3,722,703 3/1973 Domin ..... 211/201
5,016,760 5/1991 Mayo ..... 211/55
5,046,626 9/1991 Hansen ..... 211/55 X

*Primary Examiner*—Robert W. Gibson, Jr.
*Attorney, Agent, or Firm*—Olive & Olive

[57] ABSTRACT

The present invention relates to a collapsible, telescoping device for the sorting and storing of papers in an office. The paper sorter device comprises a series of sequentially smaller frames configured to nest into one another so as to conserve space when not in use. In addition, the device is adapted to be mounted on a wall or other vertical surface so as to not add to congestion on the surface of a desk, whether or not in use.

5 Claims, 3 Drawing Sheets

TELESCOPING PAPER SORTER DEVICE

FIELD OF THE INVENTION

This invention relates to the field of office equipment, and more particularly to filing or paper sorting devices.

BACKGROUND OF THE INVENTION

A major problem in the office environment is the large volume of paper which is usually present and the need to keep the papers organized and accessible. Another problem in the office is inadequate space, particularly on desktops and other work stations.

There have been many devices which stand on a desk top to hold and help one organize papers in which the papers are kept either horizontally or vertically. One drawback to all of the existing devices is that in times when they are not being used for their intended purpose, they still occupy the same amount of space on the worktop. In those instances, the space could be put to better use if it were not taken up by the paper sorter. Another drawback is that existing devices continuously occupy space on the work surface, rather than being held above it.

Therefore, an objective of the present invention is to provide a paper sorter which requires a minimum of desk space, particularly when not in use.

A further objective of the invention is to provide a paper sorter which may be partially used when document organizing requirements are minimal and thereby the sorter will occupy only a portion of the space accordingly.

An additional objective of the invention is to provide a paper sorter which may be mounted off the work surface to further conserve surface space.

Other objectives of the invention will be apparent to those skilled in the art through the disclosure which follows.

SUMMARY OF THE INVENTION

The telescoping paper sorter device of the invention is an office fixture with which one performs the function of sorting, organizing and storing papers when it is in an expanded condition, and which may be collapsed into a storage mode when not being used in order to conserve work space. The sorter consists of a series of interlocked slidable frames which are sized to nest one inside the other to take up minimum space when not being used. In the collapsed condition there is one permanently open paper storage slot into which papers may be placed, and the device is capable of being partially expanded to make as many sorting slots available as are required. The paper sorter device is designed to mount on a wall or on the side of an office machine to further conserve worktop area.

DESCRIPTION OF THE PREFERRED EMBODIMENT

The invention disclosed herein provides a space saving, uniquely functional device for the sorting of papers. By providing a series of telescoping segments, the device is capable of being used partially or fully open, and will require an amount of space in proportion to the amount of use. By comparing the views presented in FIG. 1 and FIG. 2, which illustrate the collapsed and expanded conditions of the sorter, the space utilization and flexibility incorporated in the invention will readily be seen. In the expanded condition illustrated in FIG. 2 all sorting slots A through E are available for paper organizing. In the collapsed condition illustrated in FIG. 1 the telescoping frames are fully nested and only first slot A is open for paper use.

Figure 1:
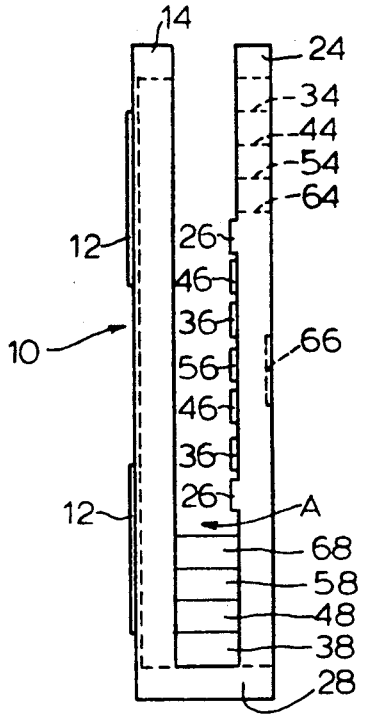
FIG. 1 is a side elevation view of the sorter device of the present invention in the collapsed condition.
Figure 2:
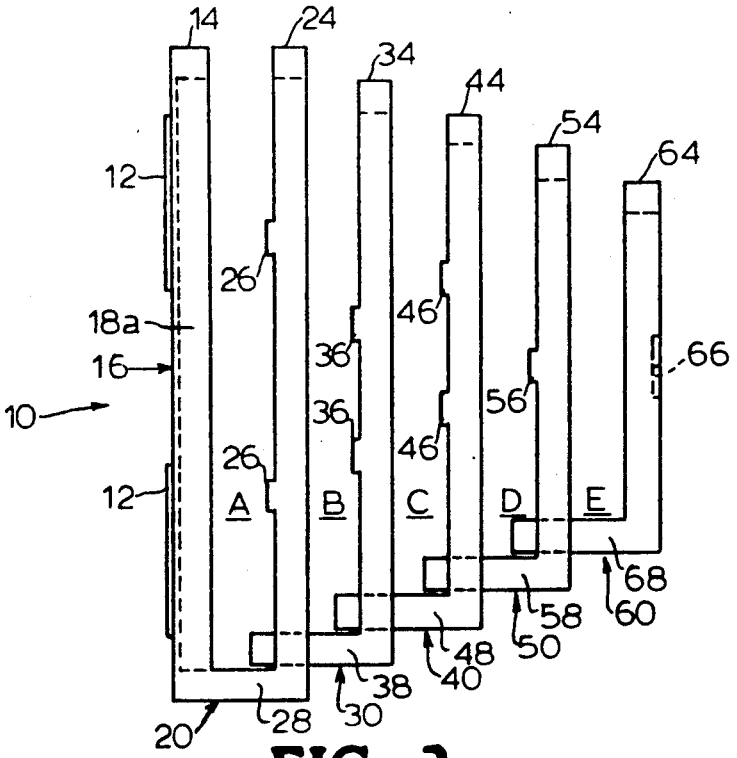
FIG. 2 is a side elevation view of the sorter device of the present invention in the expanded condition.

As seen in FIGS. 1, 2 the sorting device 10 is comprised of a series of similarly constructed but differently sized frames 30, 40, 50, 60 which all assemble to base housing 20. Each succeeding frame is smaller than its predecessor as viewed in FIG. 1 from left to right, so it is capable of nesting into its predecessor. Horizontal, planar platform members 28, 38, 48, 58, 68 of each successive frame reside in successively higher horizontal planes to conform to the telescoping design inherent in the device.

Figure 3:
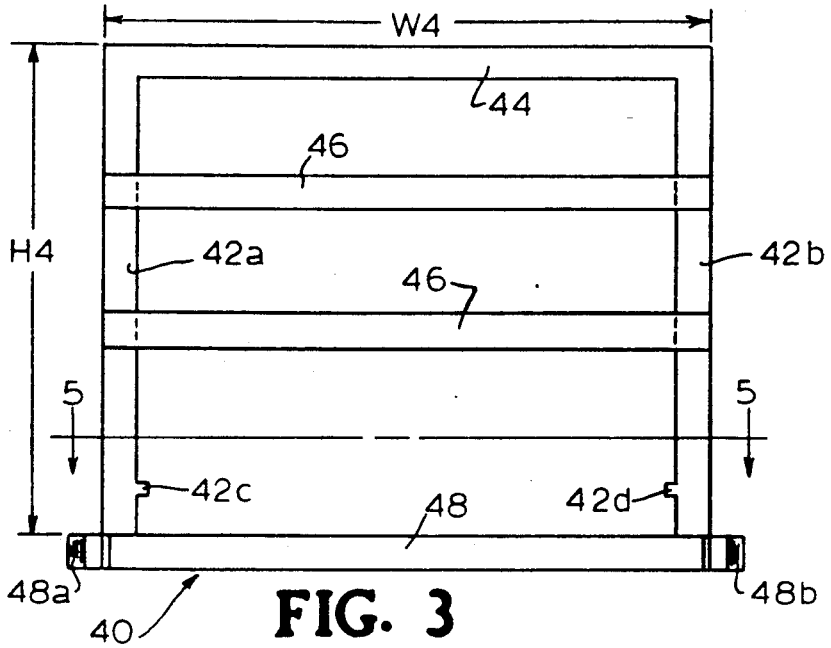
FIG. 3 is a front elevation view of a typical individual frame as used in the present invention.
Figure 4:
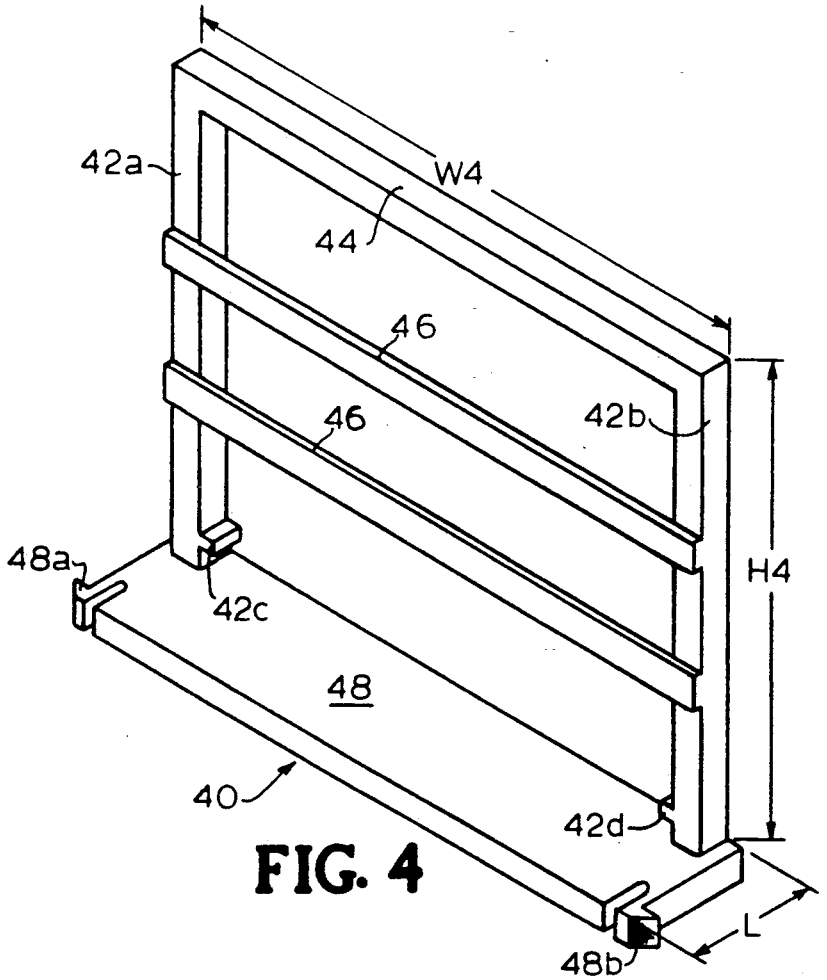
FIG. 4 is a perspective view of the typical frame of FIG. 3.

Referring now to FIGS. 3, 4 depicting a typical open frame member 40 in front elevation and in perspective view, the details of construction may be understood. Frame 40 is essentially rectangular in frontal projection, with platform member 48 forming the bottom of the frame, side struts 42*a*, 42*b* forming opposing sides and top strut 44 forming the top of the frame. The rectangle of frame 40 is dimensioned as H4 high and W4 wide; other frames 30, 50, 60 have proportional sizes according to their position in the set. Platform 48 is somewhat wider than dimension W4 with portions symmetrically extending on each side of width W4 serving to slidingly engage a track in the next larger frame, the track being similar to the track defined by protruding guides 42*c*, 42*d* on struts 42*a*, 42*b*.

Figure 5:
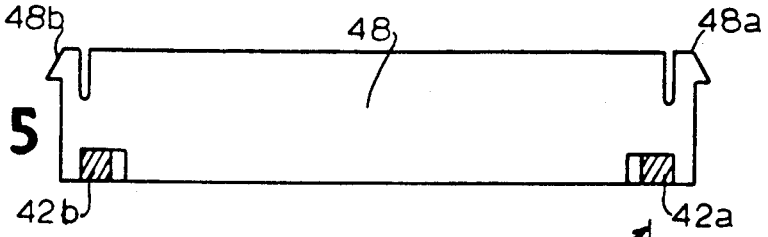
FIG. 5 is a sectional view, taken in the direction of line 5—5 of FIG. 3, of a frame of the invention, particularly depicting details of the platform retaining clips.

In perspective view in FIG. 4 and in sectional plan view in FIG. 5, it is seen that the frame side members or struts 42*a*, 42*b* are attached to platform 48 so as to have one edge flush with one long side of platform 48. At the corners of the opposite long edge of platform 48, retaining clips 48*c*, 48*d* protrude laterally outward to each side. Retaining clips 48*a*, 48*b* are formed with an outer portion defining an acute angle to the edges of platform 48. The inner portions of clips 48*a*, 48*b* are separated from the main body of platform 48 by slots in order to enable resilient flexure. As platform 48 is pushed between the struts of next larger frame 30, the angle ends of clips 48*a*, 48*b* cause an inward deformation of the clips. When the clip ends 48*a*, 48*b* pass the vertical struts of frame 30, the clip ends 48*a*, 48*b* spring outward into a resilient, latched position so as to prevent removal of platform 48. Horizontal protruding guides 42*c*, 42*d* extend inwardly from struts 42*a*, 42*b* at a height above platform 48 to slidingly engage the top surface of the next smaller platform. A pair of tracks is thereby formed by guides 42*c*, 42*d* and platform 48. Smallest platform 68 has no guides.

Figure 6:
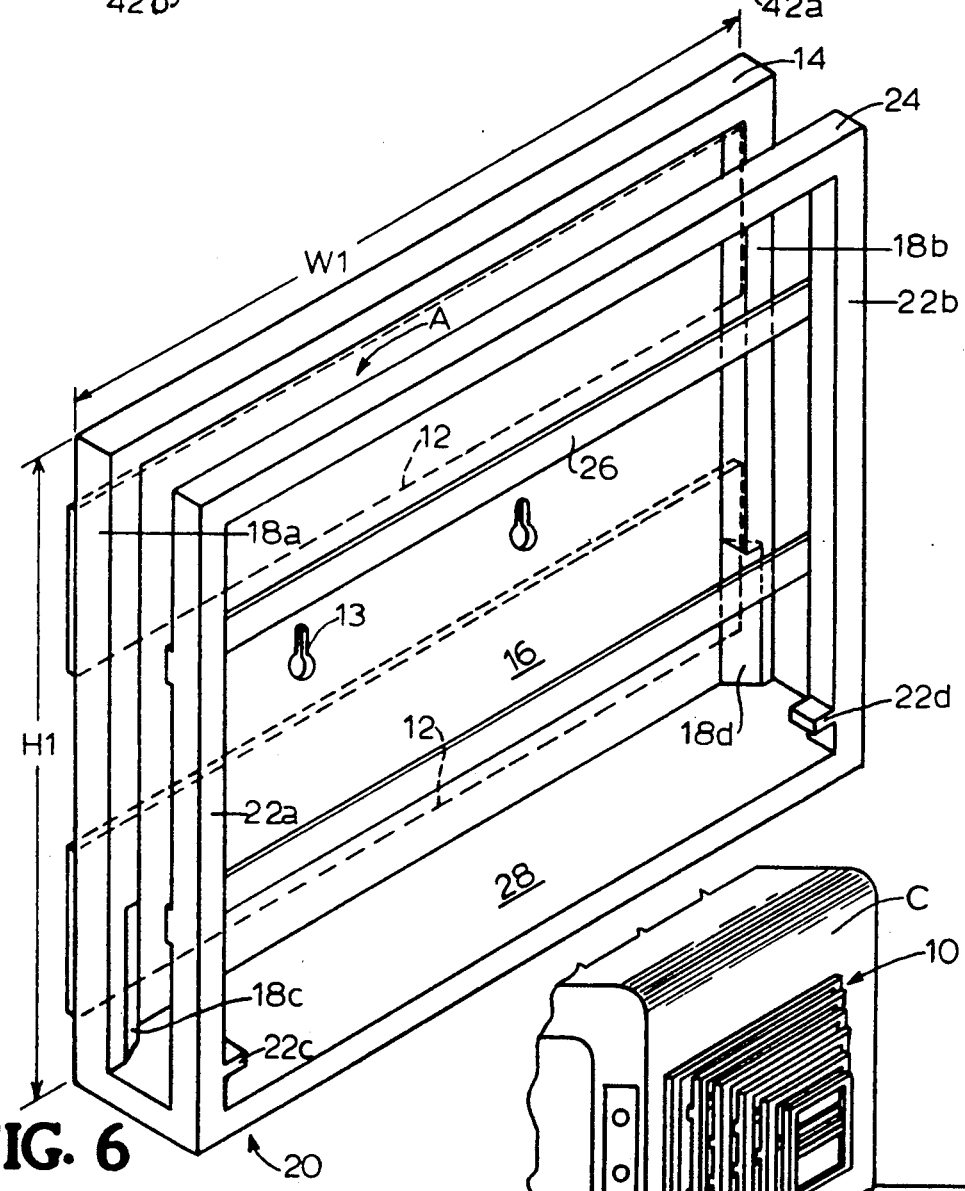
FIG. 6 is a perspective view of the base housing of the invention.

The width W4 of frame 40 (FIG. 4) is greater than the width of frame 50 which is greater than the width of frame 60; the width W4 of frame 40 is less than the width of frame 30 which is less than the width of base housing 20. The height H4 of frame 40 is greater than the height of frame 50 which is greater than the height of frame 60; the height H4 of frame 40 is less than the height of frame 30 which is less than the height of base housing 20. All bases 38, 48, 58, 68 are of equal length L, and base 28 of base housing 20 is of greater length to accommodate a rear wall 16 (FIG. 6).

FIG. 1 illustrates that each of the equivalent length platforms 38, 48, 58, 68 rest on top of another when fully collapsed and the respective struts similar to struts 42*a*, 42*b*, 44 of frame 40 recede within the frame of the next larger size. In this collapsed condition, only slot A remains open for holding papers.

Returning to FIGS. 3, 4, the upper part of frame 40 is closed by top strut 44 which spans the space from the upper end of side strut 42*a* to the upper end of side strut 42*b* and is parallel to platform 48. To prevent smaller papers from falling through the space circumscribed by platform 48, struts 42*a*, 42*b* and top strut 44, a number of relatively thin slats 46 are placed across the open area. Slats 46 are located on the forward surface of struts 42*a*, 42*b*, outside of the space described by struts 42*a*, 42*b*, 44 and are closest to wall 16. As will be seen by reference to FIGS. 1, 2, the slats on each frame 30, 40, 50, 60 are staggered in vertical location so as to not interfere with one another when sorter 10 is in the collapsed condition. Slat 66 is formed adjacent the outer surface of frame 60 farther from wall 16 so as to not be flush with other slats and to be accessible as a handle to manipulate the telescoping feature of the sorter 10.

Height H4 of typical frame 40 in the preferred embodiment being used by way of example is approximately 4.5 inches (11.4 cm.); the width W4 is also approximately 4.5 inches. Other frames 30, 50, 60, and base housing 20 of sorter 10 are larger or smaller in overall dimensions with similar proportions. All platforms are 1.0 inch (2.54 cm.) deep. Struts are approximately ¼ inch (0.63 cm.) wide by 3/16 inch (0.48 cm.) deep. Slats are approximately ¼ inch (0.63 cm.) high by 1/16 inch (0.16 cm.) deep. While the preferred embodiment employs a series of rectangular frames, the general concept would operate adequately in a triangular or semicircular shape, amoung others.

In addition to the similarly constructed frames 30, 40, 50, 60, there is also provided a base housing 20 as illustrated in perspective FIG. 6. Base housing 20 acts as a receiver and support for frames 30, 40, 50, 60. Base housing 20 comprises a platform 28 which is bounded by a strut frame at and flush with each long edge. Vertical struts 18*a*, 18*b* and top strut 14 define the back strut frame. Mounted to the rear surfaces of struts 18*a*, 18*b*, 14 is wall 16, which is integrally formed with struts 18*a*, 18*b*, 14. Wall 16 is adapted to be placed against and to be supported on a fixed vertical surface in the office in which the sorter device 10 will be used. Back wall 16 forms a planar, substantially imperforate surface which has alternate methods of attachment according to the preference of the user. One such method is shown as two strips 12 of double sided adhesive tape of appropriate length and width. The alternate method shown employs two apertures 13 formed through back wall 16 which will support sorter 10 by screws or nails placed in the office wall surface. The choice of mounting method is at the discretion of the user, taking into account the surface to be employed. The spacing between vertical struts 18*a*, 18*b* is adequate to accommodate the width of platform 38 of frame 30 and places the outer edges of struts 18*a*, 18*b* flush with the short sides of platform 28. At the lower inner corners of struts 18*a*, 18*b* an angular depression 18*c*, 18*d* is formed so as to nest retainer clips 48*a*, 48*b* and similar clips of platforms 30, 50, 60.

At each corner of the opposite long edge of platform 28 are vertical struts 22*a*, 22*b* which support top strut 24 to form an open frame similar to the others described above. Struts 22*a*, 22*b* are placed so as to be flush with the long and short sides of platform 28. Cross slats 26 connect the vertical struts 22*a*, 22*b* and are positioned to avoid interference with respective slats and struts of other frames when sorter 10 is collapsed and nested. Spaced a distance above platform 28 to slidingly engage platform 38 are track guides 22*c*, 22*d* which are on the inward facing sides of struts 22*a*, 22*b*. Base housing 20 is rigid and does not move during the nesting process so that slot A, between top strut 14 and top strut 24 is permamently open.

Having thus described the configuration of a typical frame 40 and base housing 20, attention is again directed to FIG. 2 with frame 40 shown assembled in the approximate center of sorting device 10 as expanded. It will be seen that platform 48 is above adjacent platform 38 and below adjacent platform 58 and each can slide past the others. Similarly, top strut 44 is below adjacent top strut 34 and above adjacent top strut 54. Similar relationships exist in the width dimension so that frame 40 can slide into frame 30 and have frame 50 slide into frame 40. Length L (FIG. 4) of each of the platforms 38, 48, 58, 68 are approximately equal and allow each platform to rest upon the next lower platform. When sorter 10 is collapsed, the side and top struts of each frame rest within the frame formed by vertical struts 22*a*, 22*b* and top strut 24 of base housing 20.

Sorter device 10 is made of plastic resin, for example styrene. Assembly is easily accomplished by pushing platform 68 into frame 50, platform 58 into frame 40, platform 48 into frame 30, and platform 38 into base housing 20. Once assembled, sorter 10 may be collapsed or expanded easily, but not easily disassembled.

Figure 7:
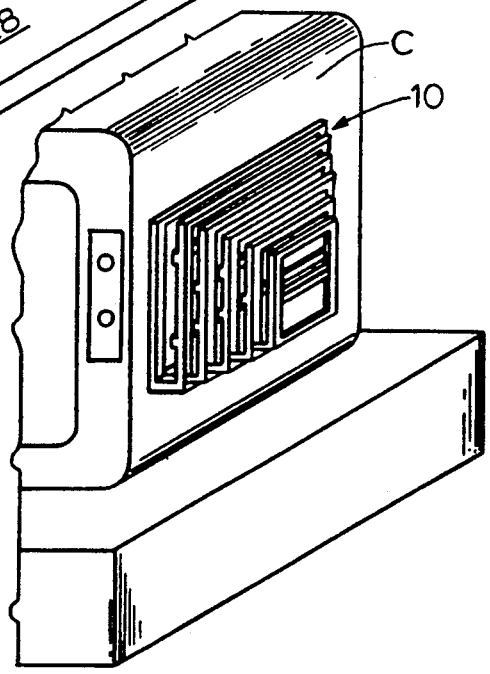
FIG. 7 is a perspective view of the sorting device of the invention as it is typically mounted for use on the side wall of a computer terminal in a working environment.

Mounting of the paper sorter of the present invention may be on the side wall of a computer terminal as illustrated in FIG. 7. An alternate system (not illustrated) is to attach smallest frame 60 to the wall surface and expand the device by pulling base housing 20 outwardly. This would serve to have each succeeding platform from platform 68 at the wall to platform 28 farthest from the wall at a relatively lower height. In that orientation one could readily see the upper edge of each paper of similar height dimensions showing above the top edge of the paper in front of it, making organization easier.

Whereas this disclosure has depicted the present invention according to a preferred embodiment, variations thereof as may be apparent to those skilled in the art are to be considered within the scope and spirit of the invention.

What is claimed is:

1. A telescoping paper sorter device comprising a plurality of open frames of different sizes, said frames being slidably interconnected and shaped so as to enable the frames to nest one within the other when slid together into a collapsed interconnected condition and to assume parallel spaced apart positions when slid apart into an expanded interconnected condition and in such expanded condition to form a series of parallel open end and open top slots, the bottom of each slot being defined by a bottom portion of a frame and the sides of each slot being bounded and defined by a pair of adjacent frames and each said slot so defined being suitable for receiving and storing papers and the like.

2. A telescoping paper sorter device as claimed in claim 1 wherein each said frame includes on a bottom side thereof a horizontal planar platform frame member slidably supported on a similar horizontal planar platform frame member of an adjacent larger size frame.

3. A telescoping paper sorter device as claimed in claim 2 wherein each said frame is of rectangular shape and is formed by a pair of laterally spaced side frame members joined in perpendicular relation to said platform frame member and a top frame member extending parallel to said platform member and joined at its ends to upper ends of said side frame members.

4. A telescoping paper sorter device as claimed in claim 3 wherein each said horizontal planar platform frame member includes latching means enabling the platform member of one frame to be releasably latched to the side frame members of another frame.

5. A telescoping paper sorter device as claimed in claim 4 wherein each said frame includes means for receiving and guiding the platform member of a smaller frame slidably interconnected therewith.

* * * * *